US006681765B2

(12) United States Patent
Wen

(10) Patent No.: US 6,681,765 B2
(45) Date of Patent: Jan. 27, 2004

(54) ANTIVIRAL AND ANTIBACTERIAL RESPIRATOR MASK

(76) Inventor: Sheree H. Wen, 796 Longhill Rd., Briarcliff Mann, NY (US) 10510

( * ) Notice: Subject to any disclaimer, the term of this patent is extended or adjusted under 35 U.S.C. 154(b) by 0 days.

(21) Appl. No.: 10/023,961

(22) Filed: Dec. 18, 2001

(65) Prior Publication Data

US 2003/0111075 A1 Jun. 19, 2003

(51) Int. Cl.[7] ..... A62B 19/00

(52) U.S. Cl. ..... 128/201.25

(58) Field of Search ..... 128/201.25, 205.12, 128/205.27, 205.28, 205.29, 909; 55/DIG. 33, DIG. 35

(56) References Cited

U.S. PATENT DOCUMENTS

| | | | | | |
|---|---|---|---|---|---|
| 4,201,205 | A | | 5/1980 | Bartholomew | |
| 4,382,440 | A | * | 5/1983 | Kapp et al. | 128/201.25 |
| 4,523,589 | A | * | 6/1985 | Krauser | 128/203.27 |
| 4,560,883 | A | | 12/1985 | Kerschgens | |
| 4,572,178 | A | * | 2/1986 | Takase et al. | 128/205.27 |
| 4,637,383 | A | * | 1/1987 | Lopez | 128/201.25 |
| 4,786,812 | A | * | 11/1988 | Humphreys | 250/455.11 |
| 4,806,768 | A | * | 2/1989 | Keutenedjian | 250/436 |
| 4,816,286 | A | | 3/1989 | Hirose | |
| 4,846,170 | A | * | 7/1989 | McAnalley et al. | 128/207.13 |
| 4,961,420 | A | | 10/1990 | Cappa et al. | |
| 5,038,768 | A | * | 8/1991 | McGoff et al. | 128/202.26 |
| 5,165,395 | A | * | 11/1992 | Ricci | 128/202.22 |
| 5,181,506 | A | * | 1/1993 | Tardiff et al. | 128/201.22 |
| 5,275,154 | A | | 1/1994 | Von Blucher et al. | |
| 5,291,881 | A | | 3/1994 | Drews et al. | |
| 5,315,987 | A | * | 5/1994 | Swann | 128/201.28 |
| 5,320,096 | A | * | 6/1994 | Hans | 128/205.29 |
| 5,323,774 | A | | 6/1994 | Fehlauer | |
| 5,337,739 | A | * | 8/1994 | Lehman | 128/205.27 |
| H1360 | H | | 10/1994 | Grove et al. | |
| 5,452,712 | A | * | 9/1995 | Richardson | 128/201.25 |
| 5,492,882 | A | * | 2/1996 | Doughty et al. | 502/417 |
| 5,589,396 | A | | 12/1996 | Frye et al. | |
| 5,635,254 | A | | 6/1997 | Holcombe et al. | |
| 5,660,173 | A | * | 8/1997 | Newton | 128/206.17 |
| 5,690,101 | A | * | 11/1997 | Kutta | 128/205.27 |
| 5,714,126 | A | * | 2/1998 | Frund | 422/122 |
| 5,755,298 | A | | 5/1998 | Langford, Jr. et al. | |
| 5,755,299 | A | | 5/1998 | Langford, Jr. et al. | |
| 5,776,838 | A | | 7/1998 | Dellinger | |
| 5,788,907 | A | | 8/1998 | Brown, Jr. et al. | |
| 5,880,042 | A | | 3/1999 | Schuster et al. | |
| 5,944,873 | A | | 8/1999 | Jager et al. | |
| 5,957,131 | A | * | 9/1999 | Hutchinson et al. | 128/206.17 |
| 6,029,712 | A | | 2/2000 | Dougherty | |
| 6,099,976 | A | | 8/2000 | Lemelson et al. | |
| 6,127,291 | A | | 10/2000 | Coppage, Jr. et al. | |
| 6,146,449 | A | | 11/2000 | Lee et al. | |
| 6,158,429 | A | * | 12/2000 | Gardner et al. | 128/201.25 |
| 6,176,239 | B1 | | 1/2001 | Grove et al. | |

(List continued on next page.)

*Primary Examiner*—Aaron J. Lewis
(74) *Attorney, Agent, or Firm*—Robert D. Katz; Cooper & Dunham LLP

(57) ABSTRACT

The invention provides a gas mask comprising a face piece including a transparent eye covering, and including a space to allow air to circulate around the nose and mouth of a wearer, and having an airtight seal to prevent contaminated air from entering the gas mask; a filtration apparatus containing an active stage and a passive stage, the passive stage for filtering out particles above a predetermined size, and including adsorbent media for removing toxic or harmful substances and fluids from the contaminated air, the active stage containing at least one agent to kill ambient bacteria and viruses; an intake vent permitting contaminated air to enter into the filtration system; at least one passageway connecting the filtration apparatus to the space around the nose and mouth of the wearer; and an exhalation port through which exhaled air may be expelled.

16 Claims, 3 Drawing Sheets

U.S. PATENT DOCUMENTS 6,219,842 B1 4/2001 Bachner, Jr.
6,233,748 B1 * 5/2001 Gieger et al. ..... 2/410
6,263,874 B1 7/2001 LeDez et al.
6,277,178 B1 8/2001 Holmquist-Brown et al.
6,321,915 B1 11/2001 Wilson et al.
6,328,031 B1 * 12/2001 Tischer et al. ..... 128/201.25
6,349,721 B1 * 2/2002 Grilliot et al. ..... 128/201.29
6,443,147 B1 * 9/2002 Matter ..... 128/200.26
6,478,025 B1 * 11/2002 Yort et al. ..... 128/201.25

* cited by examiner

ANTIVIRAL AND ANTIBACTERIAL RESPIRATOR MASK

FIELD OF THE INVENTION

The present invention is related to a mask for a human that filters air, using an active stage and a passive stage filtration system, which removes or kills gram positive and gram negative bacteria, viruses, spores, algae, fungi or protozoa, and noxious or poisonous gasses, and prevents them from entering the nasal passage.

BACKGROUND OF THE INVENTION

Airborne bacteria and viruses cause infection and disease through nasal inhalation, and pose a danger if spread accidentally or intentionally in the atmosphere. Likewise, various gasses, such as cyanide and sarin, for example, pose an extreme or lethal health threat or danger, if released into a populated civilian or military area.

Various approaches have been attempted to combat the threat of biological or chemical atmospheric contamination through the use of breathing apparatus or masks which filter out or adsorb one or more contaminants that might otherwise be breathed in by a person coming into contact with such substances or matter.

For example, U.S. Pat. No. 6,277,178 (Holmquist-Brown) relates to a respirator and filter cartridge. The respirator includes a filter cartridge that has a housing and a bonded absorbent filter element. The filtering medium may be activated carbon, which protects against gasses or vapors in the air. The absorbent filter element inside the filter cartridge fits within a sleeve, and has an interface between the bonded adsorbent filter element and the housing sleeve to prevent passage of unfiltered air around the filter element.

U.S. Pat. No. H1360 (Grove) sets forth a lightweight protective gas mask and hood. The mask has a face piece, a headpiece, and a bib formed from an elastic impervious material. A foam rubber seal, mounted on the inside surface of the hood, is located on the periphery of the face piece. Eyepieces are mounted on the face piece for permitting exterior vision from inside the hood. According to the patentee, the mask has filter cells with flexible charcoal filters mounted on the bib. Air ducts extend from an air reservoir fed by the cells to the face piece to permit filtered air to be drawn into the face piece. A flapper valve on the face piece permits air to escape from the mask.

U.S. Pat. No. 5,944,873 (Jager) relates to a device for removing one or more undesirable or dangerous substances from a gas or vapor mixture using an adsorbent. The mask includes an odorant that signals the user when the adsorbent is sufficiently spent to warrant replacement.

Still other patents discuss different types of filter media for use in a gas mask or protective respirator. U.S. Pat. No. 5,492,882 (Doughty) discusses an activated carbon adsorbent for removing noxious gasses and vapors from a contaminated air stream. The activated carbon has impregnated therein such compounds as sulfuric acid or one of its salts, molybdenum compounds, cooper compounds and zinc compounds. The adsorbents are used in universal filters. Similarly, U.S. Pat. No. 6,321,915 (Wilson) provides a filter media structure, which the patentee claims operates in the micro- and nanofiltration ranges, while offering a low cost, durable, temperature resistant medium. The filter media is a blend of carbon or ceramic fibers and inorganic fiber whiskers generally having a diameter of from about 0.03 to about 5 microns.

U.S. Pat. No. 6,146,449 (Lee) discusses a gas mask canister using a HEPA filter having plastic separating plates inserted into between HEPA filter media at certain intervals. The HEPA filter, impregnated activated carbon, and a prefilter all fit inside a cylinder that inserts into the canister portion of a respirator mask. U.S. Pat. No. 5,291,881 (Drews) discusses a slightly different type of gas mask cartridge, which has a carbon dioxide binding chemical packing and an insert, while U.S. Pat. No. 5,275,154 (von Blucher) provides an activated charcoal filter layer for gas masks formed of superimposed, highly air permeable surface structures with a layer of granular or spherical activated charcoal particles with a diameter of 0.1 to 1 mm affixed to them.

Other types of gas masks include U.S. Pat. No. 5,181,506 (Tardiff), which includes a face piece comprised of three separate layers of transparent material, the first layer soft so as to form a comfortable seal when pressed against the skin; the middle layer flexible, but shape retaining; and the outer layer protective against liquid agents. The outer layer may be quickly replaced or cleaned without removing the entire mask. U.S. Pat. No. 5,323,774 (Fehlauer) presents a breathing mask with a mask interior, through which air flows, and an indicator that warns of the presence of a toxic substance. U.S. Pat. No. 4,961,420 (Cappa) illustrates a gas mask with a face piece, a nozzle tightly engaged in a lower portion of the face piece. The nozzle allows air to flow in, while an exhaust opening, included in a portion of the mask, allows air to exit. U.S. Pat. No. 4,560,883 (Kerschgens) disclose a method and device for ultraviolet irradiation.

Each of the foregoing patents, incorporated herein in its entirety, does not appear to provide a lightweight, portable mask that can protect the user against chemical, bacterial, and viral contaminants released into or present in the air.

SUMMARY OF THE INVENTION

The present invention provides a lightweight, disposable respiration mask which can protect the user against a variety of toxic substances, both organic and inorganic, in the atmosphere, including toxic or poisonous gasses, biological contaminants including bacteria and viruses, whether naturally occurring, modified, or genetically engineered. The mask includes a hood that substantially covers the head, face and neck, and has a transparent face piece to allow the user to see his surroundings. The mask includes a breathing apparatus that includes a filter for removing toxic chemicals and hazardous biological contaminants, including bacteria and viruses. The filter preferably includes a passive filter and an active disinfectant layer or filter, which may be a chamber or a second filter with active ingredients. The passive filter removes particles such as dust, bacteria, and spores, and the active layers kill bacteria, spores and viruses that are too small to be blocked by passive filters.

The active filter may include such antibacterial, antibiotic, bacteriostatic or antiviral agents as clorohexdine, and any other antiseptic chlorine or halogen containing antiseptic compound, ethanol, methanol, menthol, lysostaphin, benzoic acid analog, lysine enzyme and metal salt, bacitracin, methicillin, cephalosporin, polymyxin, cefaclor, Cefadroxil, cefamandole nafate, cefazolin, cefixime, cefinetazole, cefonioid, cefoperazone, ceforanide, cefotanme, cefotaxime, cefotetan, cefoxitin, cefpodoxime proxetil, ceftaxidime, ceftizoxime, ceftriaxone, cefriaxone moxalactam, cefuroxime, cephalexin, cephalosporin C, cephalosporin C sodium salt, cephalothin, cephalothin sodium salt, cephapirin, cephradine, cefuroximeaxetil, dihydratecephalothin, menthol, methanol, moxalactam, loracarbef mafate and chelating agents in an amount effective to synergistically enhance the therapeutic effect of the lysine enzyme. Soybean oil, Ag, Zn, Ti, Cu, Fe in oxide or molecular form are also included.

In another embodiment, the invention provides a cartridge or filter insert for a gas or respirator mask, which includes a passive stage, having a filter medium for removing particles toxic substances, and hazardous gasses, both organic and inorganic, from air drawn through the filter, and an active stage for destroying or rendering harmless bacteria, spores, viruses, and other hazardous biological agents. The cartridge is sized to attach to fit the cartridge chamber of a standard respirator or gas mask, or may be more compact to fit as an insert in the hood or other chamber in a gas mask.

BRIEF DESCRIPTION OF THE DRAWINGS

Further objects, features, and advantages of the invention will become apparent upon review of the following detailed description of the preferred embodiments, together with the drawings in which.

DETAILED DESCRIPTION OF THE PREFERRED EMBODIMENTS

Figure 1:
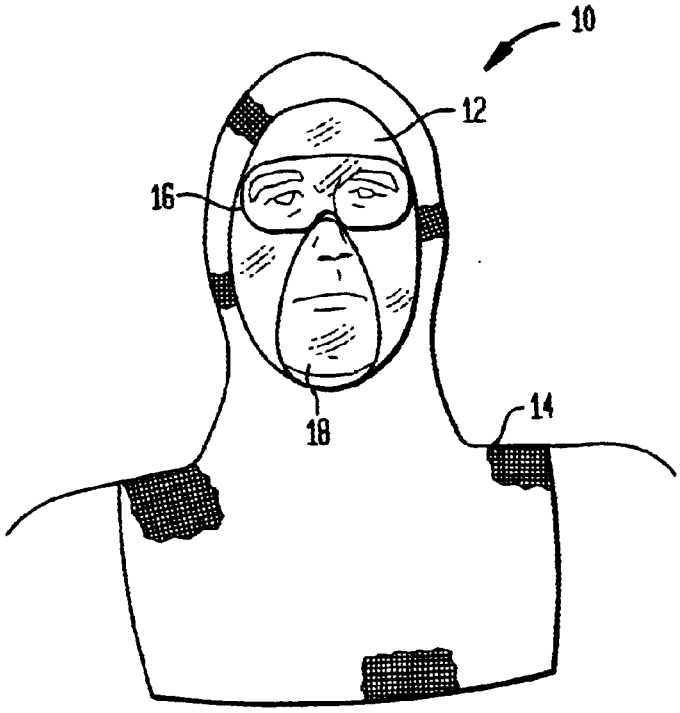
FIG. 1 is a perspective view of a person wearing the respirator mask of the present invention.

FIG. 1 illustrates a person wearing the respirator or gas mask of the present invention, generally designated by the reference numeral 10. The mask 10 includes a head covering 12 and a shoulder covering 14. The head covering 12 includes a transparent protective viewing window 16 to allow the user to see while wearing the mask 10. The mask 10 also includes a nosepiece 18 that covers the nose and mouth of the user, and allows the user to breathe freely. The mask 10 includes a respiratory filtering apparatus, either attached directly to the mouthpiece, in a conventional configuration (not shown), or integrated into the shoulder covering 14, as shown in FIG. 3.

Figure 2:
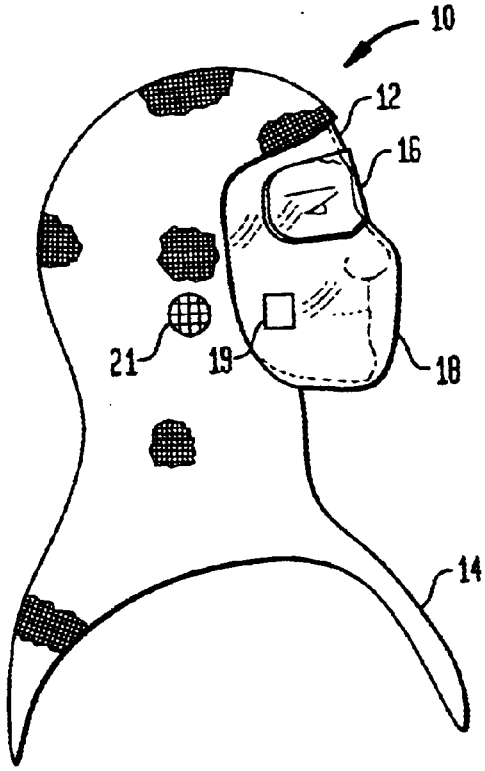
FIG. 2 is a side view of a person wearing the respirator of the present invention.

The head covering 12 can be better understood with reference to FIGS. 1 and 2. It may be a hooded covering made of an impervious fabric or other material to protect the user from absorbing hazardous materials through the skin or scalp, and can optionally include reinforcing material, such as a layer of Kevlar material, or Kevlar fibers to strengthen the covering, and to help protect the user from falling debris. Alternatively, the head covering 12 can be made to include a helmet, such as LEXAN® or other well-known plastic material well known to helmet manufacturers, including those worn by sports participants. The head covering 12 can also be treated with latex or similar natural or artificial polymeric material (including fluorocarbon polymers) to protect the user from harmful liquid agents. Use of a relatively flexible fabric material, as opposed to a stiffer, helmet-like material, allows the hood to fold up permitting more compact storage and portability of the mask 10, and increases comfort when in use. The hood or head covering 12 of the mask 10 should fit rather snugly so that the viewing window 16 and the mouthpiece 18 are against the face of the user, to offer maximum protection against leaks. The viewing window 16 should be made of an impact resistant material like LEXAN®. The viewing window 16 may be permanently joined to the head cover, or may be removable, provided the window maintains a leak proof seal to avoid penetration of toxic substances. The viewing window 16 may also be a sandwich of transparent impact resistant materials to provide heat or cold insulation.

The mouth covering 18 should preferably be transparent as well, in order to allow the mouth of the user to be visible. This will enable the user to communicate, and can be supplemented by a microphone 19 concealed in the hood, near the mouth of the user, and speaker 21 to transmit sound outside the hood. The microphone 19 and the speaker 21 should be lightweight and miniature, and should draw power from a miniature battery or other power source (not shown). Preferably, the mouth covering 18 is bubble shaped, so that the user remains comfortable while wearing the mask, and while speaking with the mask on.

Figure 3:
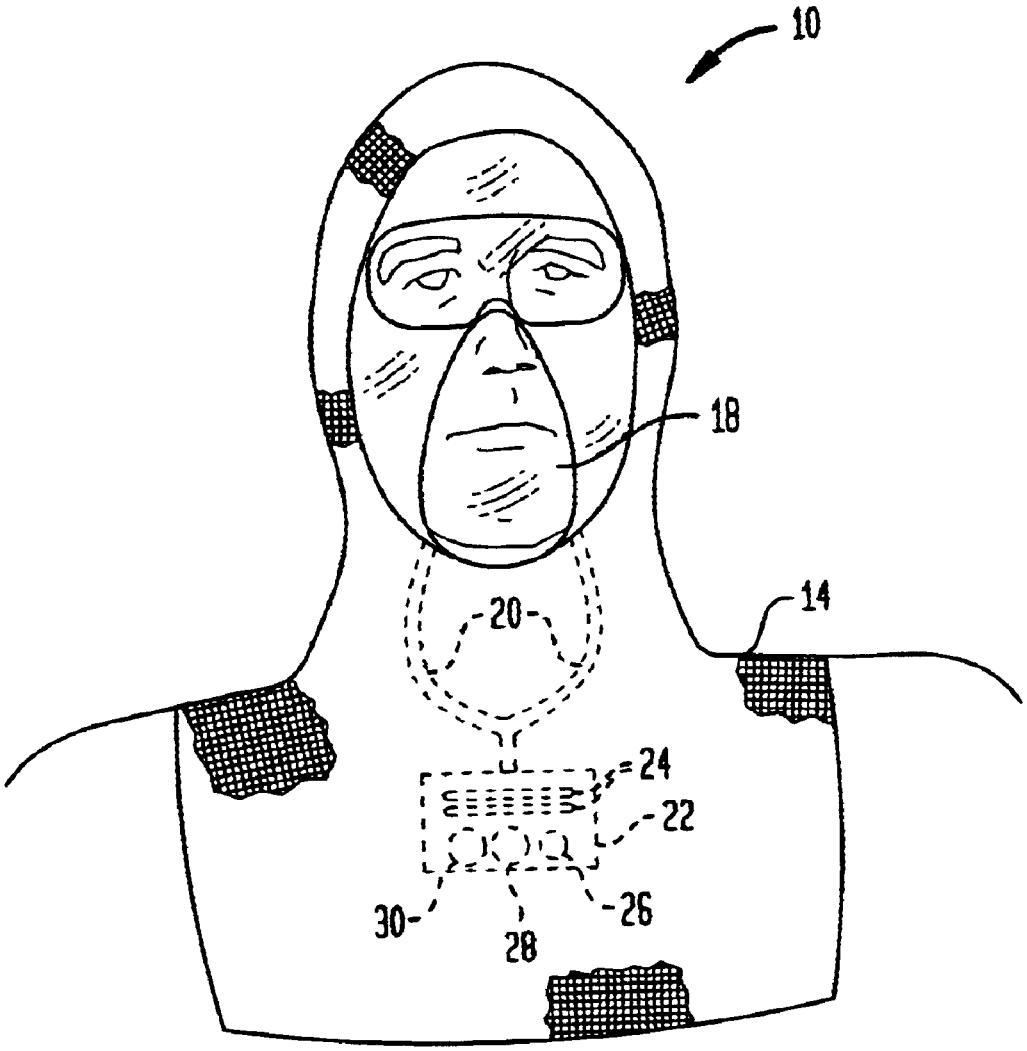
FIG. 3 is a front view of a person wearing the respirator mask of the present invention, wherein the seals, breathing passages and filtering media are shown in phantom lines.

FIG. 3 illustrates one configuration of the breathing passages in the filtration portion of the present apparatus. This configuration uses passageways 20 formed in the fabric portion of the hood to provide a simpler, less conspicuous and lighter weight air intake. The passageways 20, provided on either side of the facemask 18, culminate in an intake filter 22.

The intake filter 22 provides important advantages and features to the invention, in that it can handle a wider range of chemical and biological contaminants. To accomplish this, the filter 22 contains two stages. The first stage accomplishes filtration of most chemical and biological contaminants using activated charcoal or other similar filtration materials with extremely large surface areas per unit volume of material, in order to adsorb the contaminants before they can pass into the air passageways 20. The filtration stage that physically adsorbs a contaminant, whether in solid, liquid, gaseous form, or as vapors or particles mixed or suspended in air, can use many adsorbent materials known to those skilled in the art, including, without limitation: activated carbon, alumina, silica gel, bentonite, diatomaceous earth, ion exchange resins, powdered zeolites (both natural and synthetic), molecular sieves, and catalytic particles. The passive or physical filtration portion can also include a HEPA filter, which can filter out particles down to 0.5 to 0.3$\mu$ in size.

The second stage of the filter, the active stage, includes one or more materials which can destroy, inactivate, or render harmless biological materials, including bacteria, viruses, and the like, which could cause widespread infection if inhaled. Using the two-stage filter, the active stage will kill bacteria, spores and viruses that are too small to be blocked by passive filter stage, for example, Bacillus Anthracis, *Agrobacterium tumefaciens, Bacillus magaterium* (vegetative), *Bacillus subtillis* (vegetative), *Bacillus paratyphusus, Bacillus tetani, Clostridium tetani, Corynebacterium diptheriae, Eberthella typosa, Escherichia coli, Legionella bozimanii, dumoffii, gormanii, Legionella, longbeachae, pneumophila, Legionella nicadel, Legionella interrogans* (infectious jaundice), *Mycobacterium tuberculosis, Neisseria catarrhaiis, Phtomonas tumeficiens,*

*Proteus vulgaris, Psuedomonas aeruginosa* (laboratory & environmental), *Psuedomonas fluorescens*, Rhodospirilum Rubrum, Salmonella Enteritidis, *Salmonella paratyphi* (Enteric Fever), *Salmonella tyhimurium, Salmonella typosa* (Typhoid fever), *Sarcina lutea, Serratia marcescens, Shigelia dysenteriae, flexneri* (Dysentery), *Shigelia paradysenteriae, Shirilllum rburum, Staphylococcus, aureus, epidermidis, faecilis, Staphylococcus hemolyticus, lactis, viridans, Streptococcus faecalis, hemolyticus, lactis*, Vibrio Cholerae, Spores: *Anthrax Spores, Aspergillus flavus, Aspergillus flaucus, Aspergillus glaucus, Aspergillus niger, Bacillus magaterium, Bacillus subtillis, Mucor ramosissimus, Oospora, Penicillum digitatum, Penicillum expensum, Penicillum roqueforti, Rhizopus nigticans*, and Saccharomyces. The active ingredients can also kill algae, including, *Chlorella vulgaris*, protozoa, such as Nemotode eggs, Paramecium, and viruses, including small pox, Bacteriophage (*E. coli*), Hepatitis (all forms), influenza, poliovirus, rotavirus, tobacco mosaic virus, ebola virus, and other infectious viruses. Simiarly, the active ingredient or ingredient should be able to kill or deactivate yeast, including Baker's yeast, Brewer's yeast, Common yeast cake, Saccharomyces ellipsoideus, and cysts, such as, *Giaria llamblia* and Chryposporidium.

The actiave ingredient can be one or more of the following substances, known to destroy or render harmless any of the foregoing bacterial agents, including comprises sterilizing ingredients such as clorohexdine, ethanol, lysostaphin, benzoic acid analog, lysine enzyme and metal salt, bacitracin, methicillin, cephalosporin, polymyxin, cefaclor, Cefadroxil, cefamandole nafate, cefazolin, cefixime, cefinetazole, cefonioid, cefoperazone, ceforanide, cefotanme, cefotaxime, cefotetan, cefoxitin, cefpodoxime proxetil, ceftaxidime, ceftizoxime, ceftriaxone, cefriaxone moxalactam, cefuroxime, cephalexin, cephalosporin C, cephalosporin C sodium salt, cephalothin, cephalothin sodium salt, cephapirin, cephradine, cefuroximeaxetil, dihydratecephalothin, moxalactam, loracarbef mafate and chelating agents in an amount effective to enhance the therapeutic effect of the lysine enzyme. In addition to or instead of a chemical agent, the active stage may include one or more metallic agents, in the form of a mesh or other configuration, which can destroy ambient bacterial or viral agents. The metals may include silver, zinc, titanium, copper, or iron oxide. The active barrier may also include a chamber with micro electrical plates or magnetic coils, which generate electromagnetic energy in a form and at a strength sufficient to kill bacteriological contaminants.

The arrangement of the filter and its media in the embodiment shown in FIGS. 1 and 2 may be understood with reference to FIG. 3. The chest portion 14 of the mask 10 includes two air conduits 20 that lead from the intake vent 22 to the mouth and nosepiece 18. The intake vent 22 includes one or more openings 24 to the outside environment. The filtration apparatus 22 includes a passive portion 26 that contains activated charcoal or similar adsorbent medium to adsorb poisonous or toxic gas. The passive portion further includes a HEPA filter 28 to remove dust, hazardous particles, bacteria, and viruses having a particle size in excess of about 0.3$\mu$. The active portion 30 of the filter includes one or more of the compositions discussed above in an amount effective to destroy bacteria and viruses. The active portion can also include a miniaturized UV light or an apparatus for generating a magnetic or electric field capable of destroying bacteria and viruses. A battery (not shown) provides power to run the UV light and generate the fields. In a preferred embodiment, the active portion includes zinc mesh as an antibacterial and antiviral agent. The filter media, both active and passive, may be removed and replaced from the outside without removing the mask or exposing the user to any airborne hazard. Where one or more active ingredients are sensitive to exposure to air, it can be packed in foil or plastic, and opened just prior to use. Likewise, where the active ingredient needs moistening to activate it, the substance can be packaged with a burstable bubble package that contains water or other suitable solvent. Alternatively, it can be activated using available water or even, if necessary, with saliva.

Figure 4:
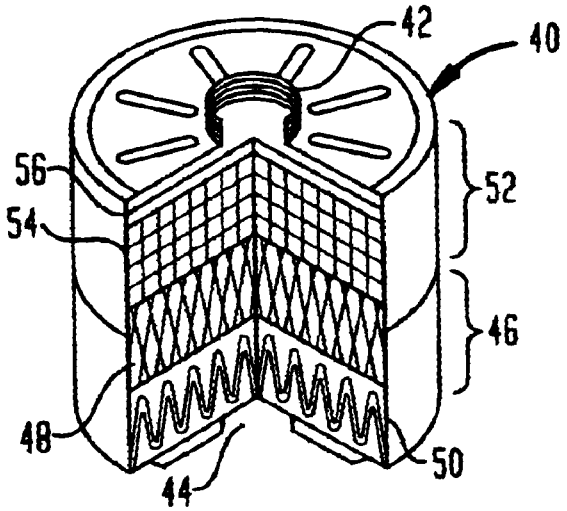
FIG. 4 is a front perspective view, partially in section, of a respirator mask filter cartridge in accordance with a second embodiment of the invention.

Another embodiment of the present invention, illustrated in FIG. 4, provides a dual stage canister 40 for use in a conventional gas mask (not shown), such as those distributed to soldiers, rescue teams and the like. As in the case of the previous embodiment, the canister 40 includes both a passive and active filtration stage. Referring to FIG. 3, the canister 40 is shaped to fit in a chamber, or attach directly using threading 42, a bayonet lock, or similar means of attachment, so that the canister 40 attaches securely to the mask, and provides an airtight seal at the attachment point. The canister 40 includes an intake valve or other opening 44, a first stage 46 containing passive filtration media, such as activated charcoal 48 or one of the other materials discussed above in connection with the other embodiment. The passive stage also includes a HEPA filter 50 to remove particles, including bacteria and other biological agents, which have a particle size over about 0.3$\mu$.

The second stage 52 or active portion of the filtration element 40 includes one or more active ingredients 54, as discussed above, to kill bacteria or viral contaminants which pass through the passive stage 46 of the filter cartridge 40. The active portion 52 can also include a miniaturized UV light or an apparatus for generating a magnetic or electric field capable of destroying bacteria and viruses 56. A battery (not shown) provides power to run the UV light and generate the fields. In a preferred embodiment, the active portion 52 includes zinc mesh as an antibacterial and antiviral agent. The filter media, both active and passive, may be removed and replaced from the outside without removing the mask (not shown) or exposing the user to any airborne hazard, through the use of a valve on the mask.

Figure 5:
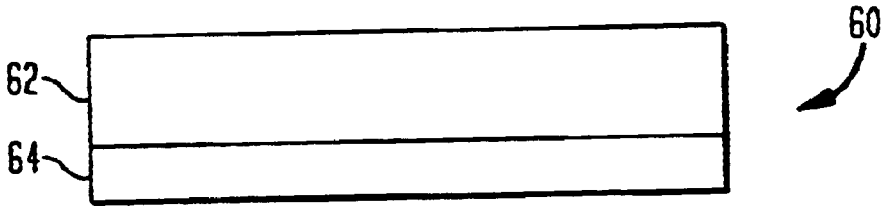
FIG. 5 is a side view of a respirator mask or filter cartridge insert in accordance with another embodiment of the invention.
Figure 6:
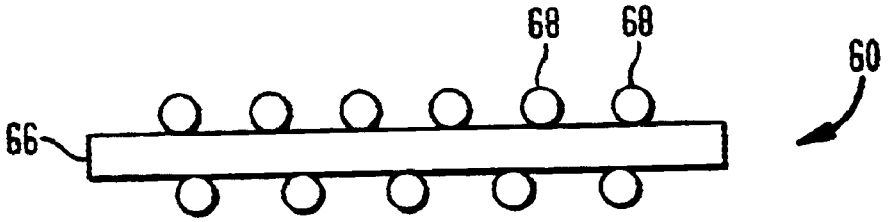
FIG. 6 is a side view of a respirator mask or filter cartridge insert in accordance with another embodiment of the invention.

In yet another embodiment, illustrated in FIG. 5, the active/passive filter medium of the present invention comprises an insert 60 for a gas mask, respirator or other breathing apparatus, which fits compactly within the hood or other head or face covering which forms a part of the safety mask. The insert 60 includes a passive layer 62, such as activated charcoal or a HEPA grade fibrous paper or woven or pressed cloth or polymeric filter. The insert 60 also includes an active layer 64 comprising one or more of the bacteriocidal or antiviral compounds discussed above (for example, chlorhexidine or other chlorine or halogen containing agent). The insert 60 can include a woven fabric impregnated with the active agent to kill ambient bacteria, fungi, and viruses as they are drawn through the insert 60. In effect, the insert 60 has one layer although it includes both active and passive components. The insert may comprise, for example, a breathable or porous woven cloth or paper filter 66 impregnated with polyvinylpyrolidone-iodine, a well-known antiseptic 68 as shown in FIG. 6. The active ingredient may be moistened to release it. It may optionally include a UV light or other radiation source to help kill biological contaminants.

While the present application shows and describes particular embodiments of the present invention, those of ordinary skill in the art will recognize that many changes and modifications may be made therein without departing from the spirit or scope of the invention. Accordingly, it is intended to cover all alternatives, modifications, and equivalents without departing from the spirit or scope of the invention. Accordingly, the following claims cover all alternatives, modifications, and equivalents as may reasonably be included based upon a fair and accurate interpretation and application thereof.

What is claimed is:

1. A gas mask comprising:

a face piece including a transparent eye covering, and including a space to allow air to circulate around the nose and mouth of a wearer, and having an airtight seal to prevent contaminated air from entering the gas mask;

a filtration apparatus containing an active stage and a passive stage, the passive stage for filtering out particles above a predetermined size, and including adsorbent media for removing toxic or harmful substances and fluids from the contaminated air, the active stage containing a UV light source, an electric or magnetic field generator to separate airborne particles from contaminated air, and at least one agent to kill ambient bacteria and viruses;

an intake vent permitting contaminated air to enter into the filtration system;

at least one passageway connecting the filtration apparatus to the space around the nose and mouth of the wearer; and an exhalation port through which exhaled air may be expelled.

2. A gas mask in accordance with claim 1, wherein the agent in the active stage is clorohexdine, ethanol, lysostaphin, benzoic acid analog, lysine enzyme and metal salt, bacitracin, methicillin, cephalosporin, polymyxin, cefaclor, Cefadroxil, cefamandole nafate, cefazolin, cefixime, cefinetazole, cefonioid, cefoperazone, ceforanide, cefotanme, cefotaxime, cefotetan, cefoxitin, cefpodoxime proxetil, ceftaxidime, ceftizoxime, ceftriaxone, cefriaxone moxalactam, cefuroxime, cephalexin, cephalosporin C, cephalosporin C sodium salt, cephalothin, cephalothin sodium salt, cephapirin, cephradine, cefuroximeaxetil, dihydratecephalothin, moxalactam, loracarbef mafate.

3. A gas mask in accordance with claim 2, wherein the agent in the active stage is lysine enzyme, and additionally comprises a chelating agent in an amount effective to enhance the effect of the lysine enzyme.

4. A gas mask in accordance with claim 1, wherein the active stage additionally comprises one or more metallic agents effective to kill bacteria and viruses.

5. A gas mask in accordance with claim 4, wherein the metal is silver, zinc, titanium, copper, or iron oxide, in the form of a mesh.

6. A gas mask in accordance with claim 1, wherein the active stage additionally comprises an IR light source electric or magnetic field generator.

7. A gas mask in accordance with claim 1, wherein the electric or magnetic field generator includes microfilaments, micro electrical plates or magnetic coils.

8. A gas mask in accordance with claim 1, wherein the agent in the active stage may be in the form of a particulate, a tablet, a tape, a mesh, a solid containing the agent, or a fabric containing the agent.

9. A cartridge for gas mask comprising:

a container having a connector for joining the container to the gas mask with an air tight seal;

a filtration apparatus containing an active stage and a passive stage, the passive stage for filtering out particles above a predetermined size, and including adsorbent media for removing toxic or harmful substances and fluids from air which enters the filtration apparatus, the active stage containing a UV light source, an electric or magnetic field generator to separate airborne particles from contaminated air, and at least one agent to kill ambient bacteria and viruses;

an intake vent permitting contaminated air to enter into the filtration apparatus; and an exhalation port through which exhaled air may be expelled.

10. A cartridge for a gas mask in accordance with claim 9, wherein the agent in the activestage is clorohexdine, ethanol, lysostaphin, benzoic acid analog, lysine enzyme, bacitracin, methicillin, cephalosporin, polymyxin, cefaclor, Cefadroxil, cefamandole nafate, cefazolin, cefixime, cefinetazole, cefonioid, cefoperazone, ceforanide, cefotanme, cefotaxime, cefotetan, cefoxitin, cefpodoxime proxetil, ceftaxidime, ceftizoxime, ceftriaxone, cefriaxone moxalactam, cefuroxime, cephalexin, cephalosporin C, cephalosporin C sodium salt, cephalothin, cephalothin sodium salt, cephapirin, cephradine, cefuroximeaxetil, dihydratecephalothin, moxalactam, loracarbef mafate.

11. A cartridge for a gas mask in accordance with claim 10, wherein the agent in the active stage is lysine enzyme, and additionally comprises a chelating agent in an amount effective to enhance the effect of the lysine enzyme.

12. A cartridge for a gas mask in accordance with claim 9, wherein the active stage additionally comprises one or more metallic agents effective to kill bacteria and viruses.

13. A cartridge for a gas mask in accordance with claim 12, wherein the metallic agent is silver, zinc, titanium, copper, or iron oxide, in the form of a mesh.

14. A cartridge for a gas mask in accordance with claim 9, wherein the active stage additionally comprises an IR light source electric or magnetic field generator.

15. A cartridge for a gas mask in accordance with claim 9 wherein the electric or magnetic field generator includes microfilaments, micro electrical plates or magnetic coils.

16. A cartridge for a gas mask in accordance with claim 9 wherein the active ingredient may be in the form of a particulate, a tablet, a tape, a mesh, a solid containing the active ingredient, or a fabric containing the active ingredient.

* * * * *